United States Patent [19]

Szlucha et al.

[11] Patent Number: 4,731,635

[45] Date of Patent: Mar. 15, 1988

[54] LIQUID INK FUSING AND CARRIER REMOVAL SYSTEM

[75] Inventors: Thomas F. Szlucha, Fairport; Dexter A. Dyer, Williamson; Michael J. Langdon, Pittsford, all of N.Y.

[73] Assignee: Xerox Corporation, Stamford, Conn.

[21] Appl. No.: 13,991

[22] Filed: Feb. 12, 1987

[51] Int. Cl.[4] ..... G03G 15/10; G03G 15/20

[52] U.S. Cl. ..... 355/10; 355/3 FU; 355/14 FU

[58] Field of Search ..... 355/3 FU, 14 FU, 3 R, 355/3 TR, 14 TR, 14 R; 219/216; 432/60; 55/266, 265, 97, 309, 312, 313, 314

[56] References Cited

U.S. PATENT DOCUMENTS

| | | | |
|---|---|---|---|
| 3,330,189 | 7/1967 | Vil | 95/1.7 |
| 3,740,867 | 6/1973 | Hamaguchi | 34/95 |
| 3,827,855 | 8/1974 | Blake | 432/60 |
| 3,857,189 | 12/1974 | Katayama et al. | 34/95 |
| 3,893,800 | 7/1975 | Wako | 432/60 |
| 3,902,845 | 9/1975 | Murphy | 432/60 |
| 4,059,394 | 11/1977 | Ariyama et al. | 432/59 |
| 4,087,676 | 5/1978 | Kukase | 219/216 |
| 4,172,975 | 10/1979 | Noda | 219/216 |
| 4,252,546 | 2/1981 | Krugmann | 55/82 |
| 4,384,783 | 5/1983 | Sakata et al. | 355/3 FU |
| 4,415,533 | 11/1983 | Kurotori et al. | 355/10 X |
| 4,462,675 | 7/1984 | Moran et al. | 355/10 X |
| 4,487,616 | 12/1984 | Grossman | 55/85 |
| 4,520,048 | 5/1985 | Ranger | 427/350 |
| 4,538,899 | 9/1985 | Landa et al. | 355/10 |
| 4,541,707 | 9/1985 | Yoshinage | 355/3 FU |
| 4,546,671 | 10/1985 | Anderson | 355/3 SH |
| 4,595,274 | 6/1986 | Sakurai | 355/3 FU |
| 4,687,319 | 8/1987 | Mishra | 355/10 |

FOREIGN PATENT DOCUMENTS

| | | |
|---|---|---|
| 156046 | 2/1985 | European Pat. Off. . |
| 1436571 | 5/1976 | United Kingdom . |

OTHER PUBLICATIONS

Gay et al, "Liquid Development", Research Disclosure, No. 21209, Dec. 1981.

*Primary Examiner*—A. C. Prescott

*Attorney, Agent, or Firm*—H. Fleischer; J. E. Beck; R. Zibelli

[57] ABSTRACT

A reproducing machine in which an electrostatic latent image recorded on a photoconductive member is developed with a liquid developer material comprising at least a liquid carrier having pigmented particles dispersed therein. The developed image is transferred from the photoconductive member to a sheet of support material. A pair of rollers cooperate with one another to define a nip through which the sheet of support material having the developed image thereon passes. The pair of rollers apply heat and pressure to the sheet of support material having the developed image thereon. The pigmented particles are fused to the sheet of support material in image configuration and the vaporized liquid carrier removed therefrom.

18 Claims, 4 Drawing Figures

LIQUID INK FUSING AND CARRIER REMOVAL SYSTEM

This invention relates generally to an electrophotographic printing machine, and more particularly concerns fusing a liquid image to a copy sheet and removing excessive liquid carrier therefrom.

Generally, the process of electrophotographic printing includes charging a photoconductive member to a substantially uniform potential to sensitize the surface thereof. The charged portion of the photoconductive member is exposed to a light image of an original document being reproduced. This records an electrostatic latent image on the photoconductive member corresponding to the informational areas contained within the original document. After the electrostatic latent image is recorded on the photoconductive member, the latent image is developed by bringing a liquid developer material into contact therewith. The liquid developer material comprises a liquid carrier having pigmented particles dispersed therein. The pigmented particles are deposited, in image configuration, on the photoconductive member. Thereafter, the developed image is transferred to the copy sheet. Invariably, some of the liquid carrier is transferred along with the pigmented particles to the copy sheet. After transfer, heat is applied to the copy sheet to permanently fuse the pigmented particles to the copy sheet and vaporize the residual liquid carrier adhering thereto. Presently, the fusing system requires a large amount of heat to fuse the pigmented particles and maintain the liquid carrier vapor levels at a safe operating condition, i.e. less than 25% of the lower explosion limit.

Numerous techniques have been developed for heating the developed image on the copy sheet to permanently fuse the pigmented particles thereto. Among these are oven fusing, hot air fusing, flash fusing and roll fusing. It has been found that roll fusing requires significantly lower energy requirements than radiant or oven fusing. Moreover, there is a reduced production of water vapor due to reducing the bulk heating of the copy sheet during the fusing of the pigmented particles thereto. In order to minimize environmental hazards and insure that the electrophotographic printing machine may be employed in an office environment, the vaporized liquid carrier cannot be vented to the atmosphere. Environmentally hazardous conditions arise when the vaporized liquid carrier is discharged to the atmosphere. Hence, it is necessary to recover the vaporized liquid carrier prior to the discharge of the liquid carrier saturated air to the atmosphere. Hereinbefore, various techniques have been devised for fusing the liquid image to the copy sheet and removing the vaporized liquid carrier. The following disclosures appear to be relevant:

U.S. Pat. No. 3,330,189, Patentee: Vil., Issued: July 11, 1967.

U.S. Pat. No. 3,740,867, Patentee: Hamaguchi, Issued: June 26, 1973.

U.S. Pat. No. 3,827,855, Patentee: Blake, Issued: Aug. 6, 1974.

U.S. Pat. No. 3,857,189, Patentee: Katayama et al., Issued: Dec. 31, 1974.

U.S. Pat. No. 3,893,800, Patentee: Wako, Issued: July 8, 1975.

U.S. Pat. No. 3,902,845, Patentee: Murphy, Issued: Sept. 2, 1975.

U.S. Pat. No. 4,059,394, Patentee: Ariyama et al., Issued: Nov. 22, 1977.

U.S. Pat. No. 4,087,676, Patentee: Fukase, Issued: May 2, 1978.

U.S. Pat. No. 4,172,975, Patentee: Noda, Issued: Oct. 30, 1979.

U.S. Pat. No. 4,384,783, Patentee: Sakata et al., Issued: May 24, 1983.

U.S. Pat. No. 4,520,048, Patentee: Ranger, Issued: May 28, 1985.

U.S. Pat. No. 4,541,707, Patentee: Yoshinaga, Issued: Sept. 17, 1985.

U.S. Pat. No. 4,545,671, Patentee: Anderson, Issued: Oct. 8, 1985.

U.S. Pat. No. 4,595,274, Patentee: Sakurai, Issued: June 17, 1986.

Great Britain Pat. No. 1,436,571, Patentee: Canon, Published: May 19, 1976.

European Patent Publication No. 156,046, Inventor: Suzuki et al., Published: Feb. 10, 1985.

The relevant portions of the foregoing disclosures may be briefly summarized as follows:

Vil discloses a fusing system in which a pair of belts advance a developed copy sheet though a zone defined by closely spaced perforated walls. Heated air is directed over the copy sheet to break up the vapor film and dry the sheet. Prior to entering the fusing system, the copy sheet passes through a pair of squeeze rollers which remove liquid developer from the sheet.

Hamaguchi describes a paper drier in a copying machine using a heat reflecting plate and a guide plate along with a transport and a moisture evaporating adsorption device.

Blake discloses a drum having a multiplicity of passageways for applying a vacuum. Toner is fixed to a sheet as it is held to the drum by the vacuum.

Katayama et al. and the Canon Great Britain Patent disclose a drying and fixing device for liquid development having a heating plate and a warm air blower. Contact pressure between a copy sheet and the heating plate is adjusted by inclining the heater member surface. The unit includes heater controls and may be equipped with a vapor recovery system.

Wako teaches backside heating and fixing by electrostatically tacking a substrate to a heater roller. A guide prevents the trailing end of of the substrate from flipping up.

Murphy describes a heated fuser roll comprising a porous reservoir of offsetting material. The offsetting material diffuses during copier operation.

Ariyama et al. discloses a heating device for fixing a toner image to one side of an image carrying copy sheet while pressing the opposite side of the sheet against a heated plate.

Fukase and Sakurai describe a method of fixing in a copier, using heat and pressure generated by and between two rolls. The backside roll can be generating heat.

Noda discloses a drying and fixing device including a heating drum and a feeder. Feed rollers made from heat resistant resin are floated on the heat drum to prevent roller tracks. The weight of the feed rollers or springs with light tracking force are used to hold the rollers in contact with the surface of the heating drum.

Sakata et al. describes a drive and pinch roller assembly to remove any remaining moisture from a copy sheet. One roller has a source of heat associated with it. A second roller is constructed of an air permeable moisture absorptive spongy material and is maintained in intimate contact against the heated roller. Residual liquid developer is absorbed into the spongy roller as the copy sheet passes between these two rollers.

Ranger discloses a system for coating substrates with a coating material which is applied in an aqueous carrier liquid. After applying the coating material to the substrate, the substrate is subjected to heat upon its face, and reduced pressure at its back surface, to remove the carrier liquid. The vacuum may emanate from a perforated plate, a perforated drum or from a vacuum box or boxes.

Yoshinaga describes a system for removing silicon oil from the copy sheet. A pair of wiping rollers are provided with material suitable for absorbing silicon oil. The silicon oil is removed from the copy sheet as it passes between the wiping rollers.

Anderson describes an apparatus for guiding and cooling a support as it exits from a heated fuser. A guide member is provided having vacuum opening to transfer heat from the copy sheet.

Suzuki et al. discloses a roller fixing device having a porous coating layer. The preferred coating material is polytetrafluoroethylene.

In accordance with one aspect of the present invention, there is provided a reproducing machine of the type having a latent image recorded on a member. Means are provided for developing the latent image recorded on the member with a liquid developer material comprising at least a liquid carrier having pigmented particles dispersed therein. Means transfer the developed image from the member to a sheet of support material. A pair of rollers are arranged to cooperate with one another to define a nip through which the sheet of support material having the developed image thereon passes. At least one of the pair of rollers is heated. The pair of rollers apply pressure to the sheet of support material having the developed image thereon so as to vaporize the liquid carrier therefrom and fuse the pigmented particles to the sheet of support material in image configuration. Means are provided for removing a substantial portion of the vaporized liquid carrier from the region of the pair of rollers.

Pursuant to another aspect of the features of the present invention, there is provided an electrophotographic printing machine having a photoconductive member and means for recording an electrostatic latent image on the photoconductive member. Means develop the latent image recorded on the photoconductive member with a liquid developer material comprising at least liquid carrier having pigmented particles dispersed therein. Means transfer the developed image from the photoconductive member to a sheet of support material. A pair of rollers are arranged to cooperate with one another to define a nip through which the sheet of support material having the developed image thereon passes. At least one of the pair of rollers is heated. The pair of rollers apply pressure to the sheet of support material having the developed image thereon so as to vaporize the liquid carrier therefrom and fuse the pigmented particles to the sheet of support material in image configuration. Means are provided for removing a substantial portion of the vaporized liquid carrier from the region of the pair of rollers.

Other aspects of the present invention will become apparent as the following description proceeds and upon reference to the drawings, in which.

While the present invention will hereinafter be described in conjunction with various embodiments thereof, it will be understood that it is not intended to limit the invention to these embodiments. On the contrary, it is intended to cover all alternatives, modifications, and equivalents as may be included within the spirit and scope of the invention as defined by the appended claims.

Inasmuch as the art of electrophotographic printing is well known, the various processing stations employed in the FIG. 1 printing machine will be shown hereinafter schematically and their operation descried briefly with reference thereto.

Figure 1:
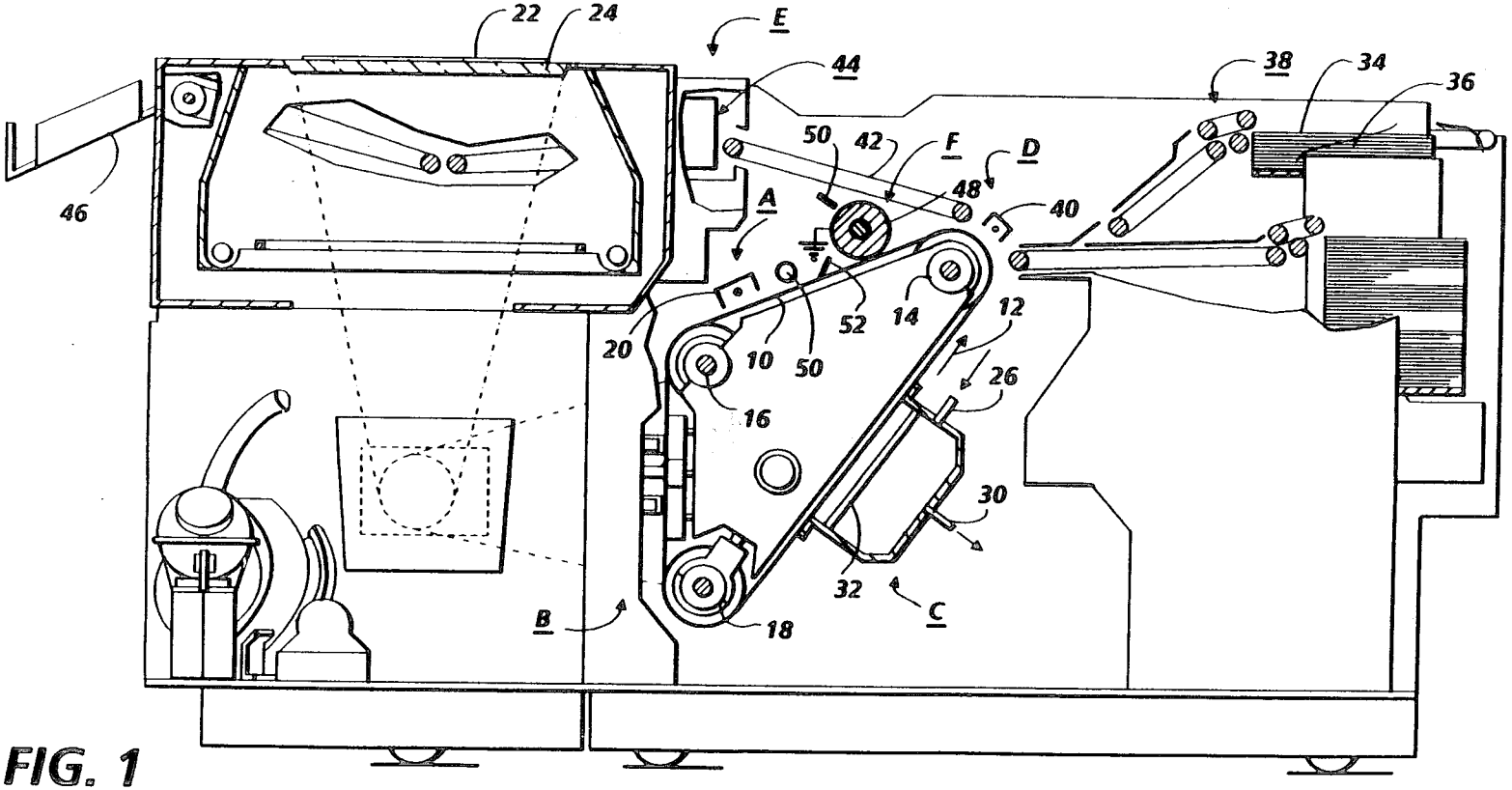
FIG. 1 is a schematic elevational view showing an illustrative electrophotographic printing machine incorporating the features of the present invention therein.

Turning now to FIG. 1, the electrophotographic printing machine employs a belt 10 having a photoconductive surface deposited on a conductive substrate. Preferably, the photoconductive surface is made from a selenium alloy with the conductive substrate being made from an electrically grounded aluminum alloy. Other suitable photoconductive surfaces and conductive substrates may also be employed. Belt 10 moves in the direction of arrow 12 to advance successive portions of the photoconductive surface through the various processing stations disposed about the path of movement thereof. Belt 10 is supported by three rollers 14, 16, and 18 located with parallel axes at approximately the apexes of a triangle. Roller 14 is rotatably driven by a suitable motor associated with a drive (not shown) to move belt 10 in the direction of arrow 12.

Initially, a portion of belt 10 passes through charging station A. At charging station A, a corona generating device, indicated generally by the reference numeral 20, charges the photoconductive surface of belt 10 to a relatively high, substantially uniform potential.

Next, the charged portion of the photoconductive surface is advanced through exposure station B. At exposure station B, an original document 22 is positioned face down upon a transparent platen 24. Lamps flash light rays onto original document 22. The light rays reflected from original document 22 are transmitted through a lens forming a light image thereof. The lens focuses the light image onto the charged portion of the photoconductive surface to selectively dissipate the charge thereon. This records an electrostatic latent image on the photoconductive surface corresponding to the informational areas contained within the original document. Thereafter, belt 10 advances the electrostatic latent image recorded on the photoconductive surface to development station C.

At development station C, a developing liquid comprising an insulating carrier liquid and toner particles, is circulated from any suitable source (not shown) through pipe 26 into development tray 28 from which it is withdrawn through pipe 30 for recirculation. Development electrode 32, which may be appropriately electrically biased, assists in developing the electrostatic latent image with the toner particles, i.e. the pigmented particles dispersed in the liquid carrier, as it passes in contact with the developing liquid. The charged toner particles, disseminated throughout the carrier liquid, pass by electrophoresis to the electrostatic latent image. The charge of the toner particles is opposite in polarity to the charge on the photoconductive surface. By way of example, if the photoconductive surface is made from a selenium alloy, the photoconductive surface will be positively charged and the toner particles will be negatively charged. Alternatively, if the photoconductive surface is made from a cadmium sulfide material, the photoconductive surface will be negatively charged and the toner particles will be positively charged. Generally, the amount of liquid carrier on the photoconductive surface is too great. A roller (not shown) whose surface moves in a direction opposite to the direction of movement of the photoconductive surface, is spaced from the photoconductive surface and adapted to shear excessive liquid from the developed image without disturbing the image.

After development, belt 10 advances the developed image to transfer station D. At transfer station D, a sheet of support material 34, i.e. a copy sheet, is advanced from stack 36 by a sheet feeder, indicated generally by the reference numeral 38. The sheet of support material advances in synchronism with the movement of the developed image on belt 10 so as to arrive simultaneously therewith at transfer station D. Transfer station D includes a corona generating device 40 which sprays ions onto the backside of the copy sheet. This attracts the developed image from the photoconductive surface to the copy sheet. After transfer, the copy sheet continues to move onto conveyor 42 which advances the sheet to fusing station E.

Fusing station E includes a fusing system indicated generally by the reference 44. The fuser assembly vaporizes the liquid carrier from the copy sheet and permanently fuses the toner particles, in image configuration, thereto. The detailed structure of the various embodiments of fusing system 44 will be described hereinafter with reference to FIGS. 2 through 4, inclusive. After fusing, the copy sheet is advanced to catch tray 46 for subsequent removal from the printing machine by the operator.

After the copy sheet is separated from the photoconductive surface of belt 10, some residual liquid developer material remains adhering thereto. This residual developer material is removed from the photoconductive surface at cleaning station F. Cleaning station F includes a cleaning roller 48, formed of any appropriate synthetic resin driven in a direction opposite to the direction of movement of the photoconductive surface to scrub the photoconductive surface clean. To assist in this action, developing liquid may be fed through pipe 50 onto the surface of cleaning roller 48. A wiper blade 52 completes the cleaning of the photoconductive surface. Any residual charge left on the photoconductive surface is extinguished by flooding the photoconductive surface with light from lamp 54.

Preferably, the developer material includes a liquid insulating carrier having pigmented particles, i.e. toner particles dispersed therein A suitable insulating liquid carrier may be made from aliphatic hydrocarbon, such as an Isopar, which is a trademark of the Exxon Corporation, having a low boiling point. The toner particles include a pigment, such as carbon black, associated with the polymer. A suitable liquid developer material is described in U.S. Pat. No. 4,582,774, issued to Landa in 1986, the relevant portions thereof being incorporated into the present application.

It is believed that the foregoing description is sufficient for purposes of the present application to illustrate the general operation of an electrophotographic printing machine incorporating the features of the present invention therein.

Figure 2:
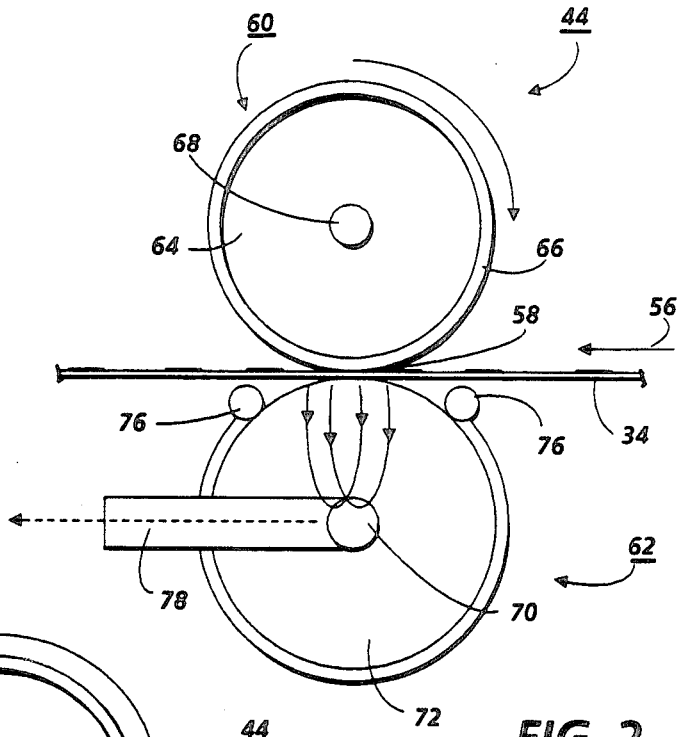
FIG. 2 is an elevational view depicting one embodiment of a fusing system used in the FIG. 1 printing machine.

Referring now to FIG. 2, there is shown one embodiment of fuser system 44 in greater detail. As depicted thereat, copy sheet 34 advances in the direction of arrow 56 into nip 58 defined by fuser roller 60 and back-up pressure roller 62. Rollers 60 and 62 are resiliently urged into engagement with one another to define nip 58. Preferably, fuser roller 60 includes a rigid internal core 64 which may be steel over which is a sleevelike covering 66, such as Silicone rubber. To heat fuser roller 60, a lamp 68 is disposed within fuser roller core 64. The core has a suitable opening for receipt of the lamp. Heat energy from the lamp permeates through the metal core and the outer sleeve to the surface of the fuser roller. This enables the fuser roller to heat the copy sheet to the requisite temperature required to fuse the pigmented particles to the copy sheet and vaporize the liquid carrier. Preferably, fuser roller 60 and pressure roller 62 apply from between 50 to 150 pounds per square inch of pressure on the copy sheet with the copy sheet being heated from about 210° F. to about 280° F. (100° to about 140° C.). At these temperatures and pressures, the pigmented particles are fused to the copy sheet and the liquid carrier vaporized. Pressure roller 62 is air pervious. Preferably, pressure roller 62 includes a rigid internal core 70 which may be steel, over which is mounted a sleeve-like cover 72 of flexible material having non-stick properties such as Teflon. A stationary, non-rotating, flexible, non-porous plastic seal 74 is entrained about a substantial portion of sleeve 72 defining a vapor removal region 76. Core 70 has a multiplicity of holes or apertures therein. Similarly, sleeve 72 has a multiplicity of holes or apertures therein. In this manner, pressure roller 62 is porous and air pervious. Core 70 has an internal chamber or opening for receiving the open end of conduit 78. Conduit 78 is coupled to a compressor system (not shown) which maintains the internal chamber of core 70 at a negative pressure with respect to atmospheric pressure. As copy sheet 34 passes into nip 58, the liquid carrier thereon vaporizes. The vaporized liquid carrier is drawn though sheet 34 (which is made from a porous material such as paper) through the openings in sleeve 72 and core 70 into conduit 78. The vaporized liquid carrier flows to a condenser (not shown) where the vaporized liquid carrier is liquefied and collected for subsequent re-use.

Figure 3:
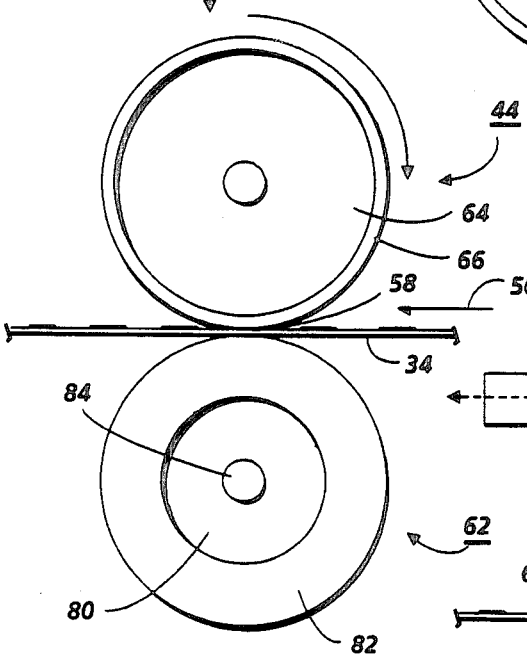
FIG. 3 is an elevational view showing another embodiment of the fusing system used in the FIG. 1 printing machine.

Turning now to FIG. 3, there is shown another embodiment of fusing system 44. The amount of liquid carrier removed from the copy sheet is a direct function of the energy input to the copy sheet. The upper boundary of the fusing window ink offsetting on the fuser roller at elevated temperatures limits, for a specific fuser configuration, the amount of energy available to drive out the liquid carrier. Increasing the dwell time can help to increase the energy delivery, but in a high speed printing machine, there are configurational constraints to long dwell times. Efficiency of liquid carrier removal from the copy sheet can be increased by supplying energy into the backside of the copy sheet. This requires heating the pressure roller and designing the fusing system to be optimized for backside copy sheet heating.

As shown in FIG. 3, copy sheet 34 advances in the direction of arrow 56 into nip 58 defined by fuser roller 60 and back-up pressure roller 62. Rollers 60 and 62 are resiliently urged into engagement with one another to define nip 58. Preferably, fuser roller 60 includes a rigid internal core 64 which may be steel over which is a sleeve-like covering 66, such as Silicone rubber. To heat fuser roller 60, a lamp 68 is disposed within fuser roller core 64. The core has a suitable opening for receipt of the lamp. Heat energy from the lamp permeates through the metal core and the outer sleeve to the surface of the fuser roller. This enables the fuser roller to heat the copy sheet to the requisite temperature required to fuse the pigmented particles to the copy sheet and vaporize the liquid carrier. Preferably, fuser roller 60 and pressure roller 62 apply from between 50 to 150 pounds per square inch of pressure on the copy sheet with the copy sheet being heated from about 210° F. to about 280° F. (100° C. to about 140° C.). At these temperatures and pressures, the pigmented particles are fused to the copy sheet and the liquid carrier vaporized. Preferably, pressure roller 62 includes a rigid internal core 80 which may be steel, over which is mounted a sleeve-like cover 82 of flexible material having non-stick properties, such as Teflon. To heat pressure roller 62, a lamp 84 is disposed within pressure roller core 80. The core has a suitable opening for receipt of the lamp. Heat energy from the lamp permeates through the metal core and the outer sleeve to the surface of the pressure roller. This enables the pressure roller to heat the backside of the copy sheet to a substantially lower temperature than the temperature that the front side of the copy sheet is heated to by fuser roller 60. One skilled in the art will appreciate that pressure roller 62 may be heated by an external heater rather than an internal heater. When this type of heating is employed, the thickness of cover 82 is not a limitation. In addition to increasing the amount of liquid carrier removed from the sheet of support material without effecting the hot offset boundary, backside heating reduces image show through. Image show though occurs when high mass solids are fused quickly at relatively high temperatures. It is believed that this defect occurs when the ink is melted quickly at high temperature causing it to become very non-viscous. This permits the ink to penetrate a sufficient depth into the copy sheet to effect opaqueness when viewed from the backside. With backside heating, a larger share of the energy required to drive the liquid carrier out of the copy sheet is produced from the non-inked side minimizing the show through defect.

Figure 4:
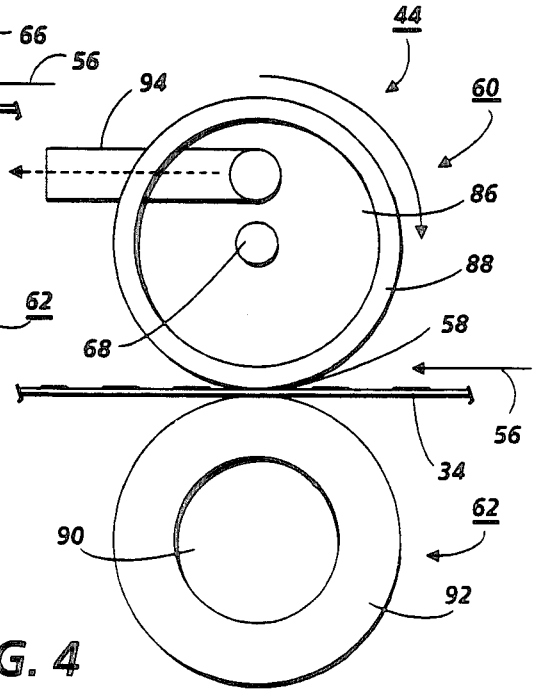
FIG. 4 is an elevational view depicting still another embodiment of the fusing system used in the FIG. 1 printing machine.

Referring now to FIG. 4, there is shown still another embodiment of fusing system 44. Fusing system 44 includes a fuser roller 60 and a pressure roller 62 resiliently urged into engagement with one another to define nip 58. Preferably, fuser roller 60 includes a rigid internal core 86 which may be steel over which is mounted a sleeve-like covering 88, such as Silicon rubber. To heat fuser roller 60, a lamp 68 is disposed within fuser roller core 86. The core has a suitable opening for receipt of the lamp. Heat energy from the lamp permeates through the metal core and the outer sleeve to the surface of the fuser roller. This enables the fuser roller to heat the copy sheet to the requisite temperature required to fuse the pigmented particles to the copy sheet and vaporize the liquid carrier. Preferably, fuser roller 60 and pressure roller 62 apply from between 50 to 150 pounds per square inch of pressure on the copy sheet with the copy sheet being heated from about 210° F. to about 280° F. (100° C. to about 140° C.). At these temperatures and pressures, the pigmented particles are fused to the copy sheet and the liquid carrier vaporized. Preferably, pressure roller 62 includes a rigid internal core 90 which may be steel, over which is mounted a sleeve-like cover 92 of flexible material having non-stick properties such as Teflon. Fuser roller 60 is air pervious. Core 86 has a multiplicity of holes or apertures therein. Similarly, sleeve 88 has a multiplicity of holes or apertures therein. In this manner, fuser roller 60 is porous and air pervious. Core 86 has an internal chamber or opening for receiving the open end of conduit 94. Conduit 94 is coupled to a compressor system (not shown) which maintains the internal chamber of core 86 at a negative pressure with respect to atmospheric pressure. As copy sheet 34 passes into nip 58, the liquid carrier thereon vaporizes. The vaporized liquid carrier is drawn from sheet 34 through the openings in sleeve 88 and core 86 into conduit 78. The vaporized liquid carrier flows to a condenser (not shown) where the vaporized liquid carrier is liquefied and collected for subsequent re-use. A system of this type does not draw the liquid carrier through the copy sheet. Thus, the copy sheet need not be porous and this system will operate with non-porous copy sheets such as transparencies made from Mylar or any other non-porous material.

In recapitulation, it is clear that the fusing system of the present invention includes a pair of rollers, at least one of which is heated, to heat and apply pressure to the copy sheet so as to permanently fuse the pigmented particles thereto in image configuration while simultaneously vaporizing the liquid carrier. The vaporized liquid carrier is removed from the region of the rollers. The liquid carrier is collected and may be recycled to the development system for subsequent reuse in the printing machine.

It is, therefore, evident that there has been provided in accordance with the present invention, a fusing system that fully satifies the aims and advantages heretofore mentioned. While this invention has been described in conjunction with various embodiments, it is evident that many alternatives, modifications and variations will be apparent to those skilled in the art. Accordingly, it is intended to embrace all such alternatives, modifications and variations that fall within the spirit and broad scope of the appended claims.

We claim:

1. A reproducing machine of the type having a latent image recorded on a member, wherein the improvement includes:

means for developing the latent image recorded on the member with a liquid developer material comprising at least a liquid carrier having pigmented particles dispersed therein;

means for transferring the developed image from the member to a sheet of support material;

a pair of rollers arranged to cooperate with one another to define a nip through which the sheet of support material having the developed image thereon passes, at least one of said pair of rollers being heated and said pair of rollers applying pressure to the sheet of support material having the developed image thereon so as to vaporize the liquid carrier therefrom and fuse the pigmented particles to the sheet of support material in image configuration; and means for removing a substantial portion of the vaporized liquid carrier from the region of said pair of rollers.

2. A reproducing machine according to claim 1, wherein said removing means is in communication with at least one of said pair of rollers.

3. A reproducing machine according to claim 2, wherein said pair of rollers includes a heated fuser roller and a pressure roller with said removing means being in communication with said pressure roller.

4. A reproducing machine according to claim 3, wherein said pressure roller includes an air pervious cylinder defining an interior chamber.

5. A reproducing machine according to claim 4, wherein said removing means maintains the interior chamber of said cylinder at a lower pressure than atmospheric pressure so that the vaporized liquid carrier passes through the sheet of support material and said cylinder to the interior chamber.

6. A reproducing machine according to claim 2, wherein said pair of rollers includes a heated fuser roller and a pressure roller with said removing means being in communication with said fuser roller.

7. A reproducing machine according to claim 6, wherein said fuser roller includes an air pervious cylinder defining an interior chamber.

8. A reproducing machine according to claim 7, wherein said removing means maintains the interior chamber of said cylinder at a lower pressure than atmosphereic pressure so that the vaporized liquid carrier passes through said cylinder to the interior chamber.

9. A reproducing machine according to claim 1, wherein said pair of rollers includes a heated fuser roller and a heated pressure roller with said pressure roller being heated to a substantially lower temperature than said fuser roller.

10. An electrophotographic printing machine, including:

a photoconductive member;

means for recording an electrostatic latent image on said photoconductive member;

means for developing the latent image recorded on said photoconductive member with a liquid developer material comprising at least a liquid carrier having pigmented particles dispersed therein;

means for transferring the developed image from said photoconductive member to a sheet of support material;

a pair of rollers arranged to cooperate with one another to define a nip through which the sheet of support material having the developed image thereon passes, at least one of said pair of rollers being heated and said pair of rollers applying pressure to the sheet of support material having the developed image thereon so as to vaporize the liquid carrier therefrom and fuse the pigmented particles to the sheet of support material in image configuration; and means for removing a substantial portion of the vaporized liquid carrier from the region of said pair of rollers.

11. A printing machine according to claim 10, wherein said removing means is in communication with at least one of said pair of rollers.

12. A printing machine according to claim 11, wherein said pair of rollers includes a heated fuser roller and a pressure roller with said removing means being in communication with said pressure roller.

13. A printing machine according to claim 12, wherein said pressure roller includes an air pervious cylinder defining an interior chamber.

14. A printing machine according to claim 13, wherein said removing means maintains the interior chamber of said cylinder at a lower pressure than atmospheric pressure so that the vaporized liquid carrier passes through the sheet of support material and said cylinder to the interior chamber.

15. A printing machine according to claim 11, wherein said pair of rollers includes a heated fuser roller and a pressure roller with said removing means being in communication with said fuser roller.

16. A printing machine according to claim 15, wherein said fuser roller includes an air pervious cylinder defining an interior chamber.

17. A printing machine according to claim 16, wherein said removing means maintains the interior chamber of said cylinder at a lower pressure than atmospheric pressure so that the vaporized liquid carrier passes through said cylinder to the interior chamber.

18. A printing machine according to claim 10, wherein said pair of rollers includes a heated fuser roller and a heated pressure roller with said pressure roller being heated to a substantially lower temperature than said fuser roller.

* * * * *